US010458002B2

(12) United States Patent
Vincent et al.

(10) Patent No.: US 10,458,002 B2
(45) Date of Patent: Oct. 29, 2019

(54) GREY GOLD ALLOY

(71) Applicant: Montres Breguet S.A., L'Abbaye (CH)

(72) Inventors: Denis Vincent, Neuchatel (CH); Stephane Lauper, Cortaillod (CH); Gaetan Villard, Cossonay (CH); Polychronis Nakis Karapatis, Premier (CH); Gregory Kissling, Macolin (CH); Alban Dubach, Bienne (CH)

(73) Assignee: Montres Breguet S.A., L'Abbaye (CH)

( * ) Notice: Subject to any disclaimer, the term of this patent is extended or adjusted under 35 U.S.C. 154(b) by 178 days.

(21) Appl. No.: 15/824,344

(22) Filed: Nov. 28, 2017

(65) Prior Publication Data

US 2018/0171436 A1 Jun. 21, 2018

(30) Foreign Application Priority Data

Dec. 20, 2016 (EP) ..... 16205419

(51) Int. Cl.

| | |
|---|---|
| ***C22C 5/00*** | (2006.01) |
| ***C22C 28/00*** | (2006.01) |
| ***C22C 5/02*** | (2006.01) |
| ***C22C 1/02*** | (2006.01) |
| ***C22F 1/14*** | (2006.01) |
| *A44C 5/18* | (2006.01) |
| *A44C 5/00* | (2006.01) |

(52) U.S. Cl.

CPC ..... *C22C 5/02* (2013.01); *C22C 1/02* (2013.01); *C22F 1/14* (2013.01); *A44C 5/00* (2013.01); *A44C 5/18* (2013.01)

(58) Field of Classification Search

CPC ..... C22C 1/02; C22C 5/02; C22F 1/14; A44C 5/00; A44C 5/18

USPC ..... 420/508; 63/3, 21, 34; D11/1, 3, 94, D11/206

See application file for complete search history.

(56) References Cited

U.S. PATENT DOCUMENTS

| | | | | |
|---|---|---|---|---|
| 4,218,244 | A * | 8/1980 | Knosp | A61K 6/046 420/509 |
| 6,210,637 | B1 * | 4/2001 | Uno | C22C 5/02 420/508 |
| 6,342,182 | B1 | 1/2002 | Vincent | |
| 6,787,102 | B2 * | 9/2004 | Vincent | A44C 27/003 148/430 |
| 6,913,656 | B2 * | 7/2005 | Tridib | C22C 5/02 148/430 |
| 2002/0127134 | A1 | 9/2002 | Vincent | |
| 2008/0095659 | A1 * | 4/2008 | Budihartono | C22C 5/06 420/505 |
| 2012/0114522 | A1 * | 5/2012 | Reigner | C22C 5/02 420/508 |
| 2014/0305164 | A1 * | 10/2014 | Lauper | A44C 27/003 63/34 |
| 2016/0138134 | A1 * | 5/2016 | Kissling | A44C 27/003 420/463 |
| 2016/0273077 | A1 | 9/2016 | Vincent et al. | |
| 2018/0112292 | A1 * | 4/2018 | Vincent | B21B 1/18 |

FOREIGN PATENT DOCUMENTS

| | | | | |
|---|---|---|---|---|
| DE | 10 2009 053 567 | A1 | 5/2011 | |
| EP | 1 010 768 | A1 | 6/2000 | |
| EP | 1227166 | A1 * | 7/2002 | A44C 27/003 |
| EP | 2251444 | A1 * | 11/2010 | C22C 5/02 |
| EP | 3 070 182 | A1 | 9/2016 | |
| EP | 3070182 | A1 * | 9/2016 | C22C 1/02 |
| WO | WO 2010/127458 | A1 | 11/2010 | |

OTHER PUBLICATIONS

European Search Report dated May 3, 2017 in European Application 16205419.1, filed on Dec. 20, 2016 (with English Translation of Categories of cited documents).

* cited by examiner

*Primary Examiner* — Patricia L. Hailey
(74) *Attorney, Agent, or Firm* — Oblon, McClelland, Maier & Neustadt, L.L.P.

(57) ABSTRACT

A grey gold alloy which is nickel-free, cobalt-free, iron-free, silver-free, zirconium-free, niobium-free, chromium-free, indium-free, gallium-free and manganese-free and includes, expressed in weight percent, from 75.0 to 76.5% of Au, from 15 to 23% of Pd, from 1 to 7% of Cu, and from 0 to 5% of at least one of the alloying elements Ir, Ru, B and Re, the respective percentages of all the elements of the alloy adding up to 100%.

14 Claims, No Drawings

GREY GOLD ALLOY

This application claims priority from European Patent Application No. 16205419.1 filed on Dec. 20, 2016, the entire disclosure of which is hereby incorporated herein by reference.

FIELD OF THE INVENTION

The present invention relates to a grey gold alloy which is nickel-free, cobalt-free, iron-free, silver-free, zirconium-free, niobium-free, chromium-free, indium-free, gallium-free and manganese-free. The invention also relates to a timepiece or piece of jewelry comprising at least one component made of such an alloy.

BACKGROUND OF THE INVENTION

There are two main sorts of grey gold alloys on the market: alloys in which the whitening metal for the gold is nickel, and those where this metal is palladium. However, alloys comprising nickel are used less and less due to their allergenic properties on contact with the skin, which precludes their use in external timepiece components. Consequently, palladium alloys are used for this function.

Grey gold alloys intended to be used in the fields of horology and jewelry must satisfy two constraints relating first to their brightness/whiteness and secondly to their capacity for deformation. They must therefore have pure white colour and brightness and excellent ductility and resistance to corrosion. More specifically, the desired grey gold alloys must have values in the L*a*b colour space (CIE 1976) such that L>80, a*<1.5 and b*<7, and preferably b*<6 and preferentially b*<5, and a Vickers hardness comprised between 140 HV and 225 HV, the lowest values being the most favourable for deformation.

As the whitening effect of palladium is less than that of nickel, these alloys necessarily have a high palladium content, which limits their mechanical properties. Further, rhodium plating is often used to improve the colour and reflectivity of the alloys, in order to enhance the brightness of the jewels when the alloys are used in settings.

This rhodium plating is a major long-term drawback because the rhodium plating layer, on the order of 1 to 5 microns, always eventually wears away. Consequently, the after-sales service is faced with an expensive re-plating operation, due to the need to conceal the difference in colour between the alloy and the rhodium improvement layer.

These colours can be compared through several references mentioned below.

EP Patent 1010768 relates to 18 carat grey gold alloys having a palladium content comprised between 12 and 14%, and also comprising copper, which gives colour values in the L*a*b colour space such that 1.8<a*<2.3 and 7<b*<10.

EP Patent 1227166 relates to 18 carat, palladium-free, grey gold alloys comprising copper and manganese, which gives colour values in the L*a*b colour space such that 2.6<a*<6 and 10<b*<13.

EP Patent 1245688 relates to 18 carat grey gold alloys having a palladium content comprised between 5 and 7%, also comprising copper and silver, which gives colour values in the L*a*b colour space such that 1.5<a*<4.5 and 10.5<b*<15.2.

The a* and b* colour values of the alloys presented in these three Patents are too high to claim that surface improvement by rhodium plating is unnecessary.

The Patent Application published under the number EP2546371A1 relates to 18 carat grey gold alloys having a palladium content comprised between 2 and 12% and a chromium content comprised between 13 and 23%, which gives colour values in the L*a*b colour space such that 0.25<a*<0.7 and 3<b*<4.2.

EP Patent No 2427582B1 relates to 18 carat grey gold alloys having a palladium content comprised between 18 and 24% and comprising between 1 and 6% of various elements comprising Zr, Nb or Mn, which gives colour values in the L*a*b colour space such that 1.1<a*<1.5 and 4.5<b*<5.7.

The alloys described in the latter two Patent Applications have sufficient a* and b* colour values to assert that surface improvement by rhodium plating is unnecessary. However, the hardness of these alloys—370 HV and 276 HV—is too high.

Tables 1 and 2 summarize the situation of the alloys previously disclosed in the prior art

TABLE 1

| | Au | Pd | Ag | Ga | Fe | Cu | Cr | Mn | Zr | Nb | In | Zn | Si | HV |
|---|---|---|---|---|---|---|---|---|---|---|---|---|---|---|
| A | 751 | 130 | | 3.5 | | 101 | | | | | 15 | | | 145 |
| B | 751 | | | | | 179 | | 50 | | | | 19 | 1 | 165 |
| C | 751 | 70 | 10 | | | 129 | | | | | | 40 | | 188 |
| D | 751 | 70 | | | 30 | | 149 | | | | | | | 370 |
| E | 751 | 190 | | | | | | 19 | 20 | 20 | | | | 276 |
| F | 751 | 210 | | | | | | | 20 | 19 | | | | 184 |

TABLE 2

| | L | a* | b* |
|---|---|---|---|
| A | 80.0 | 2.1 | 7.7 |
| B | 86.3 | 3.5 | 12.9 |
| C | 80.6 | 3.2 | 12.2 |
| D | 80.9 | 0.3 | 2.6 |
| E | 81.2 | 1.0 | 3.9 |
| F | 81.4 | 1.1 | 4.3 |

EP Patent Application 3070182 A1 relates to a grey gold alloy which is nickel-free, cobalt-free, iron-free, silver-free, copper-free, zirconium-free, niobium-free, chromium-free and manganese-free, comprising, expressed in weight percent, from 75.0 to 76.5% of Au, from 15 to 23% of Pd, from 0.5 to 5% of Rh, from 0 to 7% of Pt, and from 0 to 5% of at least one of the alloying elements Ir, Ru, Ti, In, Ga, B and Re, the respective percentages of all the elements of the alloy adding up to 100%.

Due to its precious metal content, this alloy can only be exclusively used for the manufacture of fine jewelry.

SUMMARY OF THE INVENTION

It is therefore an object of the present invention to substantially improve grey gold alloys by providing a grey gold alloy which is nickel-free, cobalt-free, iron-free, silver-free, zirconium-free, niobium-free, chromium-free, indium-free, gallium-free and manganese-free, that dispenses with rhodium plating without reducing the deformability properties of the alloy.

It is thus an object of the present invention to substantially improve grey gold alloys by providing a grey gold alloy which is nickel-free, cobalt-free, iron-free, silver-free, zirconium-free, niobium-free, chromium-free, indium-free, gallium-free and manganese-free, whose deformability allows for transformation through cold rolling and drawing techniques with no risk of cracking and which is economical to produce.

It is another object of the present invention to provide a grey gold alloy which is nickel-free, cobalt-free, iron-free, silver-free, zirconium-free, niobium-free, chromium-free, indium-free, gallium-free and manganese-free, which offers an advantageous compromise between colour and brightness of sufficient whiteness to meet the aesthetic requirements of the field of external watch parts, thereby avoiding a rhodium plating operation.

It is another object of the present invention to provide a grey gold alloy which is nickel-free, cobalt-free, iron-free, silver-free, zirconium-free, niobium-free, chromium-free, indium-free, gallium-free and manganese-free that is easy to polish and has a high whiteness level after polishing.

It is another object of the present invention to provide a grey gold alloy which is nickel-free, cobalt-free, iron-free, silver-free, zirconium-free, niobium-free, chromium-free, indium-free, gallium-free and manganese-free and has lower production costs.

To this end, the present invention relates to a grey gold alloy which is nickel-free, cobalt-free, iron-free, silver-free, zirconium-free, niobium-free, chromium-free, indium-free, gallium-free and manganese-free and comprises, expressed in weight percent, from 75.0 to 76.5% of Au, from 15 to 23% of Pd, from 1 to 7% of Cu, and from 0 to 5% of at least one of the alloying elements Ir, Ru, B and Re, the respective percentages of all the elements of the alloy adding up to 100%.

With an alloy conforming to the aforementioned definition, there is obtained a grey gold alloy meeting all the criteria required for alloys intended to be used in the fields of horology and jewelry, particularly as regards colour, brightness, production costs and the capacity for cold working with no risk of cracking. This is coupled with excellent corrosion resistance.

The present invention also concerns a timepiece or a piece of jewelry comprising at least one component made of an alloy as defined above. This component is, for example a watch case, a dial, a bracelet or wristband, a bracelet clasp, a jewel or an accessory.

The present invention also concerns the use of an alloy as defined above in a timepiece or piece of jewelry.

DETAILED DESCRIPTION OF PREFERRED EMBODIMENTS

The alloy of the present invention is a grey gold alloy which is nickel-free, cobalt-free, iron-free, silver-free, indium-free, gallium-free, manganese-free, zirconium-free, chromium-free and niobium-free.

According to a first embodiment, the gold alloy is an 18 carat alloy and comprises, expressed in weight percent, from 75.0 to 76.5% of Au, from 15 to 23% of Pd, from 1 to 7% of Cu, and from 0 to 5% of at least one of the alloying elements Ir, Ru, B and Re, the respective percentages of all the elements of the alloy adding up to 100%.

According to a second embodiment, the gold alloy is an 18 carat alloy and comprises, expressed in weight percent, from 75.0 to 76.5% of Au, from 17 to 22.5% of Pd, from 2 to 7% of Cu, and from 0 to 5% of at least one of the alloying elements Ir, Ru, B and Re, the respective percentages of all the elements of the alloy adding up to 100%.

According to a third embodiment, the gold alloy is an 18 carat alloy and comprises, expressed in weight percent, from 75.0 to 76.5% of Au, from 18 to 22.5% of Pd, from 2 to 6.5% of Cu, and from 0 to 4% of at least one of the alloying elements Ir, Ru, B and Re, the respective percentages of all the elements of the alloy adding up to 100%.

According to a fourth embodiment, the gold alloy is an 18 carat alloy and comprises, expressed in weight percent, from 75.0 to 76.5% of Au, from 18.5 to 22% of Pd, from 2.5 to 6.5% of Cu, and from 0 to 3% of at least one of the alloying elements Ir, Ru, B and Re, the respective percentages of all the elements of the alloy adding up to 100%.

According to a fifth embodiment, the gold alloy is an 18 carat alloy and comprises, expressed in weight percent, from 75.0 to 76.5% of Au, from 18.5 to 21.5% of Pd, from 3 to 6% of Cu, and from 0 to 2.5% of at least one of the alloying elements Ir, Ru, B and Re, the respective percentages of all the elements of the alloy adding up to 100%.

According to a sixth embodiment, the gold alloy is an 18 carat alloy and comprises, expressed in weight percent, from 75.0 to 76.5% of Au, from 19 to 21% of Pd, from 3.5 to 5.5% of Cu, and from 0 to 1.8% of at least one of the alloying elements Ir, Ru, B and Re, the respective percentages of all the elements of the alloy adding up to 100%.

According to a variant of the above embodiments, the gold alloy may also be rhodium-free.

According to any of the variants of the above embodiments, the gold alloy can comprise at least one of the elements Ir, B, with each element in a proportion comprised between 0.002 and 1% by weight.

In any of the variants of the above embodiments where the alloy comprises B, the proportion of B is preferably comprised between 0.002 and 0.2%, and more preferably comprised between 0.08 and 0.2%.

In any of the variants of the above embodiments where the alloy comprises Ir, the proportion of Ir is preferably comprised between 0.002 and 0.13% by weight.

In any of the variants of the above embodiments where the alloy comprises Re, the proportion of Re is preferably comprised between 0.001 and 0.05% by weight, and more preferably comprised between 0.001 and 0.002% by weight.

In any of the variants of the above embodiments where the alloy comprises Ru, the proportion of Ru is preferably comprised between 0.002 and 1% by weight, and more preferably comprised between 0.008 and 0.015% by weight.

In a particularly preferred composition, the gold alloy according to the invention is an 18 carat alloy and comprises, expressed in weight percent, from 75.0 to 76.5% of Au, from 19 to 21% of Pd, from 3.5 to 5.5% of Cu, and from 0.08 to 0.2% of B, the respective percentages of all the elements of the alloy adding up to 100%.

The gold alloys of the invention find particular application in the production of timepieces or pieces of jewelry. In this application, the alloy avoids the need for the electrodeposition of rhodium, which is commonly used in the fields of horology and jewelry to give the treated parts a brightness and colour of satisfactory whiteness.

To prepare the grey gold alloy according to the invention, the procedure is as follows:

The main elements involved in the composition of the alloy have a purity of between 999 and 999.9 per thousand and are deoxidised.

The elements of the alloy composition are placed in a crucible and heated until the elements melt.

Heating is performed in a sealed induction furnace under a partial pressure of nitrogen.

The melted alloy is poured into an ingot mould.

After solidifying, the ingot is water hardened.

Next, the hardened ingot is cold rolled and then annealed. The rate of strain hardening between each annealing is from 66 to 80%.

Each annealing operation lasts between 20 to 30 minutes and occurs at 900° C. in a reducing atmosphere constituted of $N_2$ and $H_2$.

Cooling between each annealing is accomplished by water quenching.

The following examples were produced in accordance with the conditions set out in Table 3 below and all relate to 18 carat grey gold alloys, made for comparative purposes (examples 1 to 3) and in accordance with the invention (examples 4 and 5). The proportions indicated are expressed in weight percent.

TABLE 3

| N° | Au % | Pd % | B % | Cu % |
|---|---|---|---|---|
| 1 (comp.) | 75.1 | 15 | 0 | 9.9 |
| 2 (comp.) | 75.1 | 17.5 | 0 | 7.4 |
| 3 (comp.) | 75.1 | 24.9 | 0 | 0 |
| 4 (inv.) | 75.2 | 20 | 0.13 | 4.67 |
| 5 (inv.) | 75.1 | 19.5 | 0.08 | 5.31 |

Table 4 below sets out different properties of the alloys obtained from examples No 1 to No 5 of Table 1.

Table 4 provides, in particular, indications relating to the Vickers hardness of the alloy in the annealed state, and to the colour measured in a three-axis coordinate system.

This three-dimensional measuring system known as CIELab, CIE being the acronym for the International Commission on Illumination and Lab the axes of the three coordinates; the L axis measures the white-black component (black=0; white=100), the a axis measures the red-green component (red=positive values +a; green=negative values −a), and the b axis measures the yellow-blue component (yellow=positive values +b; blue=negative values −b). (cf. International standard ISO 7724 established by the International Commission on Illumination).

The colorimetric values are measured with a MINOLTA CM 3610 d apparatus in the following conditions:

Illuminant: D65

Tilt: 100

Measurement: SCI+SCE (specular component included+excluded)

UV: 100%

Focal length: 4 mm

Calibration standard: black body and white body

TABLE 4

| N° | L | a* | b* | HV Hardness |
|---|---|---|---|---|
| 1 (comp.) | 80.15 | 1.72 | 6.28 | 128 |
| 2 (comp.) | 80.31 | 1.50 | 5.79 | 122 |
| 3 (comp.) | 80.44 | 1.19 | 4.41 | 117 |
| 4 (inv.) | 80.49 | 1.46 | 5.21 | 174 |
| 5 (inv.) | 80.70 | 1.41 | 5.25 | 163 |

The 18 carat gold grey alloys of the invention (examples 4 and 5) were developed and tested for deformation to meet the triple constraint of brightness/whiteness, capacity for deformation and the production cost required for alloys intended to be used in the field of horology and jewelry. The alloys therefore present colour values such that L>80, a*<1.5 and b*<5.5, a hardness comprised between 140 HV and 225 HV, and preferably comprised between 140 HV and 180 HV, and a reduced production cost.

The alloys of the prior art and of the comparative examples (examples 1 to 3) do not meet this triple constraint.

What is claimed is:

1. A grey gold alloy, which is nickel-free, cobalt-free, iron-free, silver-free, zirconium-free, niobium-free, chromium-free, indium-free, gallium-free and manganese-free, comprising, expressed in weight percent, the following elements:

75.0 to 76.5% of Au, 15 to 23% of Pd, 1 to 7% of Cu, 0 to 5% of at least one of the alloying elements Ir, Ru, B and Re, the respective percentages of all the elements of the alloy adding up to 100%.

2. The grey gold alloy according to claim 1, comprising, expressed in weight percent, from 75.0 to 76.5% of Au, from 17 to 22.5% of Pd, from 2 to 7% of Cu, and from 0 to 5% of at least one of the alloying elements Ir, Ru, B and Re, the respective percentages of all the elements of the alloy adding up to 100%.

3. The grey gold alloy according to claim 1, comprising, expressed in weight percent, from 75.0 to 76.5% of Au, from 18 to 22.5% of Pd, from 2 to 6.5% of Cu, and from 0 to 4% of at least one of the alloying elements Ir, Ru, B and Re, the respective percentages of all the elements of the alloy adding up to 100%.

4. The grey gold alloy according to claim 1, comprising, expressed in weight percent, from 75.0 to 76.5% of Au, from 18.5 to 22.5% of Pd, from 2 to 6.5% of Cu, and from 0 to 3% of at least one of the alloying elements Ir, Ru, B and Re, the respective percentages of all the elements of the alloy adding up to 100%.

5. The grey gold alloy according to claim 1, comprising, expressed in weight percent, from 75.0 to 76.5% of Au, from 18.5 to 21.5% of Pd, from 3 to 6% of Cu, and from 0 to 2.5% of at least one of the alloying elements Ir, Ru, B and Re, the respective percentages of all the elements of the alloy adding up to 100%.

6. The grey gold alloy according to claim 1, comprising, expressed in weight percent, from 75.0 to 76.5% of Au, from 19 to 21% of Pd, from 3.5 to 5.5% of Cu, and from 0 to 1.8% of at least one of the alloying elements Ir, Ru, B and Re, the respective percentages of all the elements of the alloy adding up to 100%.

7. The alloy according to claim 1, wherein the alloy comprises at least one of the elements Ir, B, each element being in a proportion comprised between 0.002 and 1% by weight.

8. The alloy according to claim 1, wherein the alloy comprises between 0.002 and 0.2% by weight of B.

9. The alloy according to claim 8, wherein the alloy comprises between 0.08 and 0.2% by weight of B.

10. The alloy according to claim 1, wherein the alloy comprises between 0.002 and 0.13% by weight of Ir.

11. The alloy according to claim 1, wherein the alloy comprises between 0.001 and 0.05% by weight of Re.

12. The alloy according to claim 1, wherein the alloy comprises between 0.002 and 1% by weight of Ru.

13. A timepiece or piece of jewellery comprising at least one component made of an alloy according to claim 1.

14. The timepiece or piece of jewellery according to claim 13, wherein the component is selected from the group constituted of a watch case, a dial, a bracelet or wristband, a bracelet clasp, a jewel and an accessory.

* * * * *